US007403624B2

(12) United States Patent
Zoso et al.

(10) Patent No.: US 7,403,624 B2
(45) Date of Patent: Jul. 22, 2008

(54) BTSC ENCODER AND INTEGRATED CIRCUIT

(75) Inventors: Luciano Zoso, Chandler, AZ (US); Allan P. Chin, Phoenix, AZ (US); David P. Lester, Phoenix, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 1134 days.

(21) Appl. No.: 10/744,619

(22) Filed: Dec. 23, 2003

(65) Prior Publication Data

US 2005/0135630 A1 Jun. 23, 2005

(51) Int. Cl.
*H04R 5/00* (2006.01)

(52) U.S. Cl. ..... 381/2; 348/485

(58) Field of Classification Search ..... 381/1–6, 381/14, 16–23; 700/94; 348/479–481, 483–485
See application file for complete search history.

(56) References Cited

U.S. PATENT DOCUMENTS 4,503,553 A * 3/1985 Davis ..... 381/303
5,953,067 A 9/1999 Avalos et al.
6,118,879 A * 9/2000 Hanna ..... 381/106
6,192,086 B1 2/2001 Darr
6,259,482 B1 * 7/2001 Easley et al. ..... 348/485
6,288,747 B1 9/2001 Avalos et al.
6,445,422 B2 * 9/2002 Avalos et al. ..... 348/485
2004/0042621 A1 * 3/2004 Hausman ..... 381/2
2006/0083384 A1 * 4/2006 Zoso et al. ..... 381/23

* cited by examiner

*Primary Examiner*—Vivian Chin
*Assistant Examiner*—Lun-See Lao
(74) *Attorney, Agent, or Firm*—Michael J. Balconi-Lamica

(57) ABSTRACT

A BTSC encoder includes dual channel ADC, sync separator, audio processor, filtering device, and a composite audio signal generating device. The filtering device includes a first filter for providing a filtered L+R signal, and a second filter for providing at least one of: i) a filtered and combined pilot and modulated L−R signal and ii) separately filtered pilot and modulated L−R signals. The composite audio signal generating device is responsive to the filtered L+R signal, and at least one of i) the filtered and combined pilot and modulated L−R signal and ii) the separately filtered pilot and modulated L−R signals for generating and outputting a composite analog audio signal. In all embodiments, the modulated L−R signal is filtered via an anti-splatter filter.

24 Claims, 6 Drawing Sheets

BTSC ENCODER AND INTEGRATED CIRCUIT

BACKGROUND

The present disclosure relates to stereophonic audio encoders, and more particularly, to single-chip BTSC encoders.

RELATED ART

At present DVD players, stereo VCRs, set-top boxes, gaming stations and similar audio/video applications output composite video and stereo audio through three separate connectors (video, left audio and right audio). In view of the complexity in using three separate cables, a popular method of connecting TV sets to other audio/video applications is through a single RF cable, wherein the single RF cable conveys both composite video and mono audio. However, in such a typical home entertainment configuration, the stereo audio provided by cable television or satellite equipment is not passed on to the audio/video equipment, such as VCRs and television sets, because stereo audio is only available through the left and right outputs of the set-top box, but not through the RF output of the same.

In NTSC systems, the stereo audio signals are encoded with the Broadcast Television System Committee (BTSC) encoding. The standard for Multichannel Television Sound (MTS) was adopted in 1984 by the FCC for television broadcast of stereo audio. The BTSC encoder generates a composite audio signal consisting of a Left+Right (L+R) channel (main channel), a pilot tone, and an encoded and modulated Left−Right (L−R) channel (stereo channel). The main channel occupies the spectrum from 50 Hz to 14 kHz and has a 25 kHz peak deviation. The pilot tone is a single frequency spectral line at approximately 15.734 kHz (exactly the horizontal line rate of the NTSC system). The stereo channel is a double sideband suppressed carrier signal centered at approximately 31.468 kHz (exactly twice the horizontal line rate of the NTSC system) with a bandwidth of 28 kHz. The peak deviation of the stereo channel is 50 kHz.

Traditional BTSC encoding systems typically use an analog approach and are very expensive. The analog approach is complex, requires substantial space, and is not easily integrated with other system functions. Furthermore, the manufacturing process for the analog circuitry requires adjustments and analog circuitry is subject to environmental and aging effects that can noticeably degrade device performance. Due to cost and complexity, analog BTSC encoders have been used mainly in broadcast quality equipment, and not in equipment for general consumer applications.

Digital solutions are more suitable for consumer applications. Existing digital BTSC encoders are typically implemented in digital signal processor (DSP) chips or field programmable gate arrays (FPGAs). However, such chips are costly relative to application specific integrated circuits (ASICs) when mass produced. Furthermore, expensive external analog to digital converters (ADCs), digital to analog converters (DACs) and sync separators are necessary.

In traditional digital BTSC encoders, the modulated L−R channel is much noisier than the L+R channel. When combining the two channels together, the L−R channel out-of-band noise is added to the L+R channel as well, thus affecting an overall system performance.

Accordingly, there is a need for an improved method and apparatus for overcoming the problems in the art as discussed above.

SUMMARY

According to an embodiment of the present disclosure, a BTSC encoder includes a dual channel ADC, sync separator, audio processor, filtering device, and a composite audio signal generating device. The filtering device includes a first filter or delay for providing a filtered or delayed L+R signal, and a second filter for providing at least one of: i) a filtered and combined pilot and modulated L−R signal and ii) separately filtered pilot and modulated L−R signals. The composite audio signal generating device is responsive to the filtered L+R signal, and at least one of i) the filtered and combined pilot and modulated L−R signal and ii) the separately filtered pilot and modulated L−R signals for generating and outputting a composite analog audio signal. In one embodiment, the modulated L−R signal is filtered via an anti-splatter filter.

BRIEF DESCRIPTION OF THE DRAWINGS

The present invention is illustrated by way of example and not limited by the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION

The present embodiments relate to stereophonic audio encoders used for audio/video consumer electronics and more specifically to a fully integrated digital BTSC compatible encoder. In one embodiment, a single-chip BTSC encoder incorporates an Audio Processor, a dual-channel Sigma-Delta ADC, a dual-channel Sigma-Delta DAC, and a Sync Separator. The BTSC signal processing algorithms can include, for example, commercially available signal processing algorithms available from Cable Electronics, Inc.

A BTSC encoder, in conjunction with an RF modulator, provides composite video and high-quality stereo sound through a single RF coaxial cable. As a result, it will greatly simplify the typical home entertainment wiring. Moreover, this allows consumer electronics manufacturers to lower overall system costs.

Figure 1:
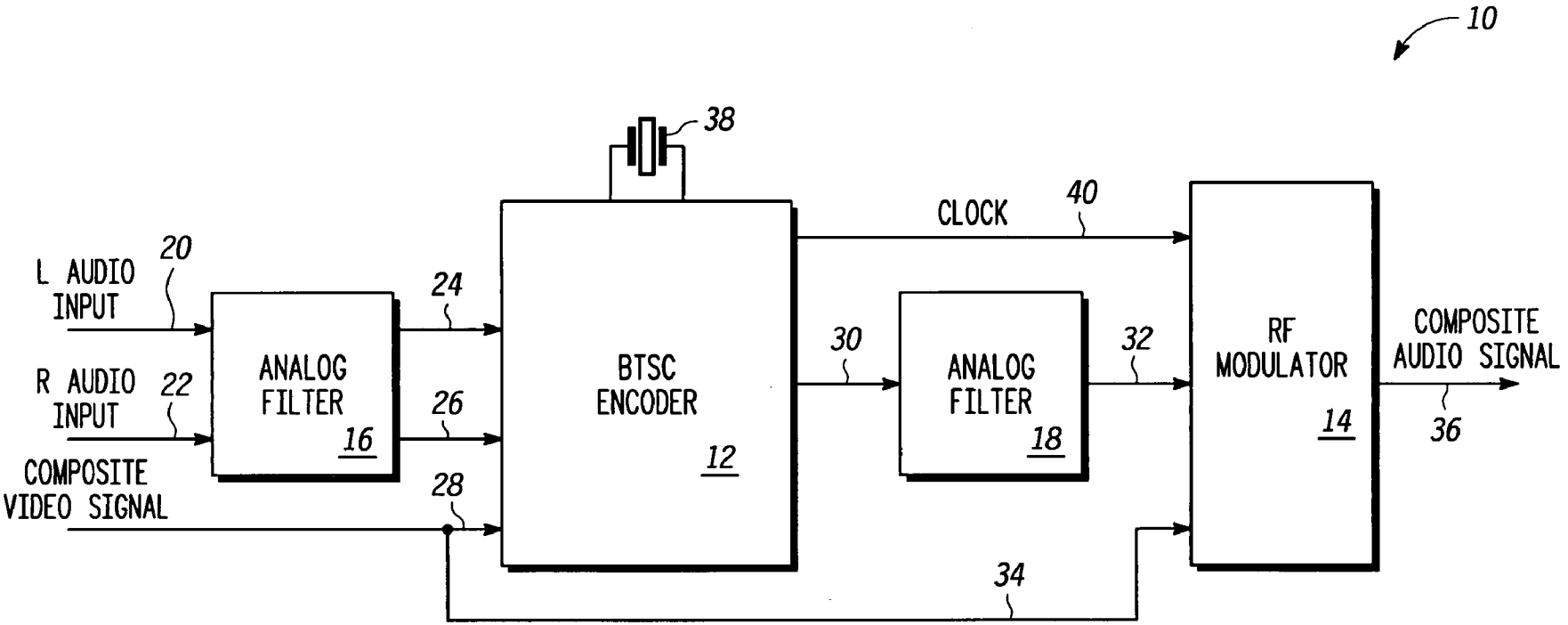
FIG. 1 is a schematic block diagram view of a composite video and stereo audio system having a BTSC encoder with an RF modulator according to one embodiment of the present disclosure.

FIG. 1 is a schematic block diagram view of a composite video and stereo audio system 10 having a BTSC encoder 12 with an RF modulator 14 according to one embodiment of the present disclosure. System 10 further includes analog filters 16 and 18. Furthermore, system 10 may be implemented as an integrated circuit implementation of the BTSC encoder, RF modulator, and analog filters.

Analog filter 16 includes a left audio input 20 for receiving a left audio input signal and a right audio input 22 for receiving a right audio signal. Responsive to the left audio and right audio input signals, analog filter 16 outputs filtered left and right audio input signals on filter output signal lines 24 and 26, respectively. Analog filter 16 is an anti alias filter and is used to filter frequencies that may cause spurious outputs from the ADC.

BTSC encoder 12 includes a left audio input 24, a right audio input 26, and a composite video input. The left audio input 24 is adapted for receiving a left audio input signal, for example, a filtered L audio input signal. The right audio input 26 is adapted for receiving a right audio signal, for example, a filtered R audio input signal. Furthermore, the composite video input 28 is adapted for receiving a composite video signal. Responsive to the left audio, right audio, and composite input signals, the BTSC encoder 12 digitally encodes the left and right audio input signals into a composite audio signal and outputs the composite audio signal on a composite analog audio output 30. In one embodiment, the BTSC encode 12 includes a single-chip BTSC encoder.

RF modulator 14 includes a composite audio input 32 coupled to the composite audio output 30 of the BTSC encoder 12, for example, via analog filter 18, for receiving the composite audio output signal. RF modulator 14 further includes a composite video input 34 for receiving the composite video signal. Responsive to the input signals, RF modulator 14 modulates the composite audio and video input signals into an RF modulated output signal and outputting the RF modulated output signal on an RF modulated output 36 of the RF modulator. Analog filter 18 is a smoothing filter and filters any spurious signals outside the frequency band of the composite audio signal.

In addition, as illustrated in FIG. 1, a crystal 38 couples to BTSC encoder 12. Crystal 38 is adapted for use in connection with providing clocking signals internal to the BTSC encoder 12, as well as, providing a clocking signal external to the BTSC encoder. For example, an external clock signal is provided on signal line 40 coupled to RF modulator 14, for supplying RF modulator 14 with appropriate timing from a clock within BTSC encoder 12.

Accordingly, the BTSC encoder chip accepts left and right analog audio signals, as well as a baseband composite video signal. Responsive to the input signals, the BTSC encoder generates L+R and modulated L−R signals in accordance with the standards for the BTSC system. In the past, the two channels were required to be added together in the analog domain to generate a composite audio signal. However, with the embodiments of the present disclosure, adding of the two channels in the analog domain is no longer necessary, because the BTSC encoder chip produces the composite audio directly. Such a BTSC encoder chip is believed the industry's first single-chip BTSC encoder.

Figure 2:
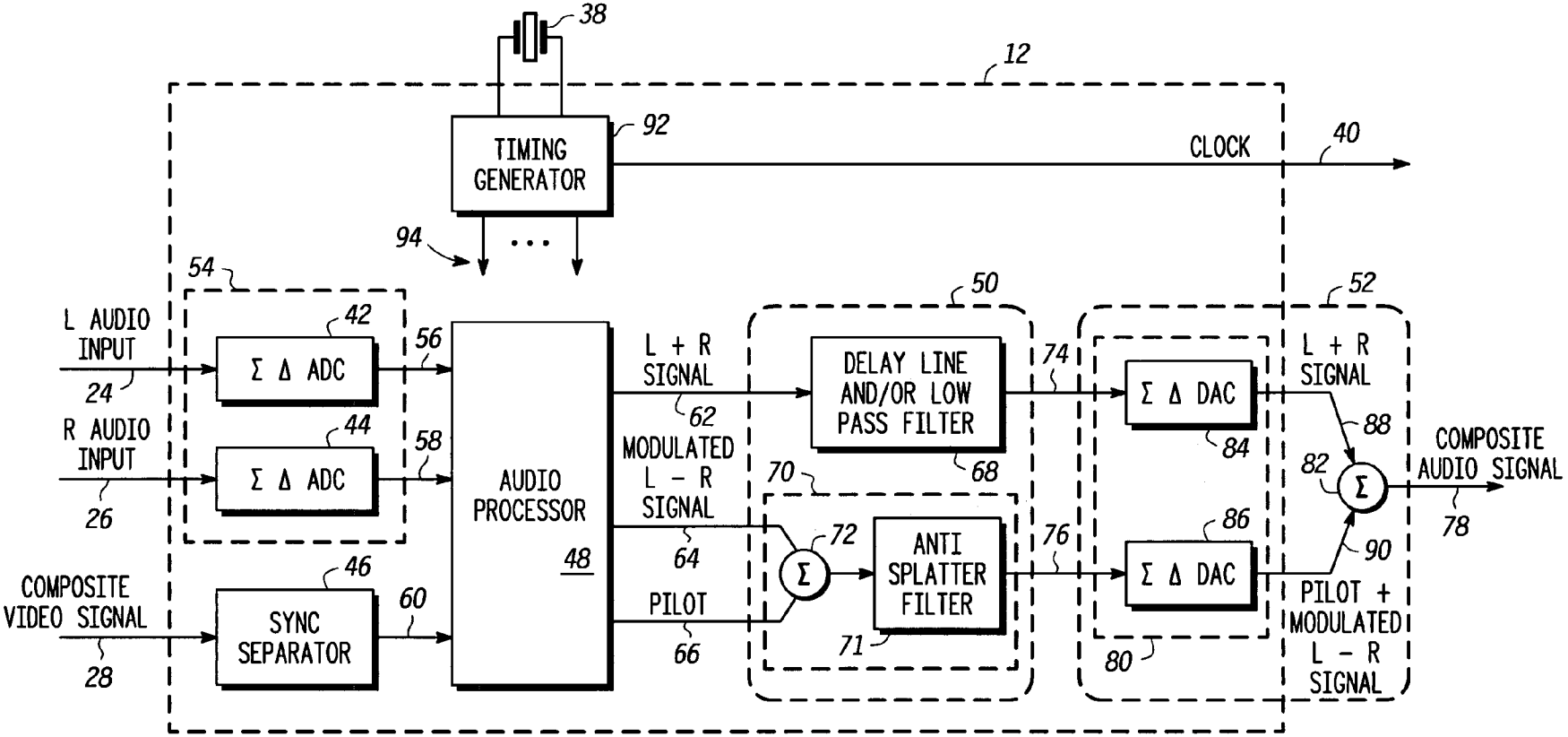
FIG. 2 is a schematic block diagram view of a BTSC encoder of FIG. 1 in further detail according to one embodiment of the present disclosure.

FIG. 2 is a schematic block diagram view of a BTSC encoder of FIG. 1 in further detail according to one embodiment of the present disclosure. BTSC encoder 12 includes analog-to-digital converters (ADCs) (42,44), a sync separator 46, an audio processor 48, filtering means 50, and composite audio signal generating means 52.

In one embodiment, analog-to-digital converters (42,44) include a dual-channel sigma-delta analog-to-digital converter (ADC) 54. Dual-channel sigma-delta ADC 54 has a left (L) audio input 24 adapted for receiving a left (L) audio signal and a right (R) audio input 26 adapted for receiving a right (R) audio signal. Responsive to L audio and R audio input signals, the dual-channel sigma-delta ADC 54 converts the input signals into left and right digital audio output signals, respectively, and outputs the left and right digital audio output signals onto left and right digital audio outputs, respectively, designated by reference numerals 56 and 58.

Sync separator 46 includes a composite video input 28 adapted for receiving a composite video signal. Responsive to the composite video input signal, sync separator 46 separates a horizontal synchronization signal from the composite video input signal and outputs the synchronization signal on a synchronization output 60.

Audio processor 48 includes left and right digital audio inputs coupled to the left and right digital audio outputs (56,58) of the dual-channel sigma-delta ADC 54. Audio processor 48 also includes a synchronization signal input coupled to the synchronization output 60 of the sync separator 46. Responsive to left and right digital audio input signals and a synchronization signal, the audio processor 48 processes the input and synchronization signals into an L+R signal, a modulated L−R signal, and a pilot tone signal. Furthermore, the audio processor outputs the L+R, modulated L−R, and pilot tone signals on an L+R output 62, a modulated L−R output 64, and a pilot tone output 66, respectively.

Filtering means 50 couples to the L+R output 62, the modulated L−R output 64, and the pilot tone output 66 of the audio processor 48. In the embodiment of FIG. 2, the filtering means 50 includes a first filter 68 for providing a filtered or delayed L+R signal, and a second filter 70 for providing a filtered and combined pilot and modulated L−R signal. The second filter 70 includes an anti-splatter filter 71 and a digital summer 72, wherein the modulated L−R and pilot are combined via the digital summer 72. Furthermore, the filtering means 50 outputs the filtered L+R signal on a first output 74, and outputs the filtered and combined pilot and modulated L−R signal on a second output 76.

Composite audio signal generating means 52 couples to the first output 74 and the second output 76. Responsive to the filtered L+R signal and the filtered and combined pilot and modulated L−R signal, the composite audio signal generating means generates a composite audio signal. The composite signal generating means 52 outputs the composite audio signal on a composite analog audio signal output 78.

As discussed above, the second filter 70 of filtering means 50 provides a filtered and combined pilot and modulated L−R signal. In one embodiment, the second filter 70 includes a digital summer 72 for combining the pilot and modulated L−R signals. The digital summer 72 couples to an input of anti-splatter filter 71, the anti-splatter filter having an output for providing the filtered and combined pilot and modulated L−R signal output corresponding to second output 76. Anti-splatter filter 71 reduces an amount of an out-of-band noise added to the L+R signal as a function of a combination of the pilot tone and an unfiltered modulated L−R signal. In one embodiment, the anti-splatter filter 71 includes one of a bandpass filter and a highpass filter. In another embodiment, the first filter includes 68 includes one of a delay line and a low pass filter.

Referring still to FIG. 2, composite audio signal generating means 52 includes a dual-channel sigma-delta digital-to-analog converter (DAC) 80 and an analog summing device 82. In one embodiment, dual-channel sigma-delta DAC 80 includes a first input coupled to the L+R output 62 of audio processor 48, for example, via filtering means 50. Dual-channel sigma-delta DAC 80 further includes a second input coupled to the modulated L−R signal output 64 and pilot tone output 66 of audio processor 48, for example, via filtering means 50. Responsive to the L+R digital audio signal and the combined modulated L−R digital audio and pilot tone signal, the dual-channel sigma-delta DAC 80 converts the input signals into L+R and combined pilot and modulated L−R analog audio output signals, respectively. Further more, the dual-channel sigma-delta DAC outputs the L+R and combined pilot and modulated L−R analog audio output signals on outputs 88 and 90, respectively.

The analog summing device 82, in one embodiment, includes a L+R analog audio input and a combined pilot and modulated L−R analog audio input coupled to the L+R and combined pilot and modulated L−R analog audio outputs 88 and 90, respectively, of the dual-channel sigma-delta DAC, 80. Analog summing device 82 is adapted for summing the L+R and combined modulated L−R analog audio output signals into a composite analog audio signal. The analog summing device 82 outputs the composite analog audio signal on an analog summing device output 78.

Further with respect to FIG. 2, BTSC encoder 12 includes a timing generator 92. Crystal 38 couples to timing generator 92, wherein timing generator 92 provides one or more clock signal outputs, as discussed herein, or as may be required for a particular BTSC encoder application. For example, in one embodiment, timing generator 92 provides clock output 40 and additional clock outputs generally designated by reference numeral 94.

In one embodiment, the sigma-delta ADC 54 and the dual-channel sigma-delta DAC 80 each perform respective conversions at a substantially equal or same clock rate. The clock rate is in the range of 96 to 384 kHz. In one embodiment, the clock rate is on the order of approximately 187.5 kHz. Furthermore, in another embodiment, BTSC encoder 12 includes a single-chip BTSC encoder and wherein the analog summing device 82 is disposed external to the single-chip BTSC encoder, as shown in FIG. 2.

Accordingly, the embodiments of the present disclosure provide a more cost-effective solution by the fully integrated digital systems as presented herein. All signal processing is digitally performed by the audio processor 48, while on-chip converters and a sync separator interface the chip 12 with the external analog world. Since oversampling converters are used, anti-aliasing and smoothing filters (16 and 18, respectively) are very simple. Only a few passive components must be added externally.

In one embodiment, an original frequency plan using a sampling frequency of 187.5 kHz was devised to reduce the complexity of the clock generation. Accordingly, all clocks can be derived directly from the crystal oscillator, thus avoiding the use of a phase-locked-loop (PLL). In particular, the clock generator, in addition to generating the clocks for all the blocks of the encoder, also generates a clock for use by an RF modulator. By supplying the clock directly to the RF modulator, some system simplification is achieved, in view of the fact that an additional crystal would no longer be needed.

In traditional digital encoders, the modulated L−R channel is much noisier than the L+R channel. When adding the two channels together, the L−R channel out-of-band noise is added to the L+R channel as well, thus affecting the overall system performance. This issue has been solved by using a digital anti-splatter filter as disclosed herein. The filter has very tight phase distortion requirements.

In existing digital encoders input audio signals are digitized at a baseband sampling frequency $F_s$. Part of the signal processing is performed at $F_s$ and part at $4F_s$. Interpolators are required to upsample the signals. According to one embodiment of the present disclosure, a higher rate of 187.5 kHz is used to sample the incoming audio signals and to perform all BTSC signal processing. In this way, a simplified decimator is needed in the ADCs and no interpolator is required.

Figure 3:
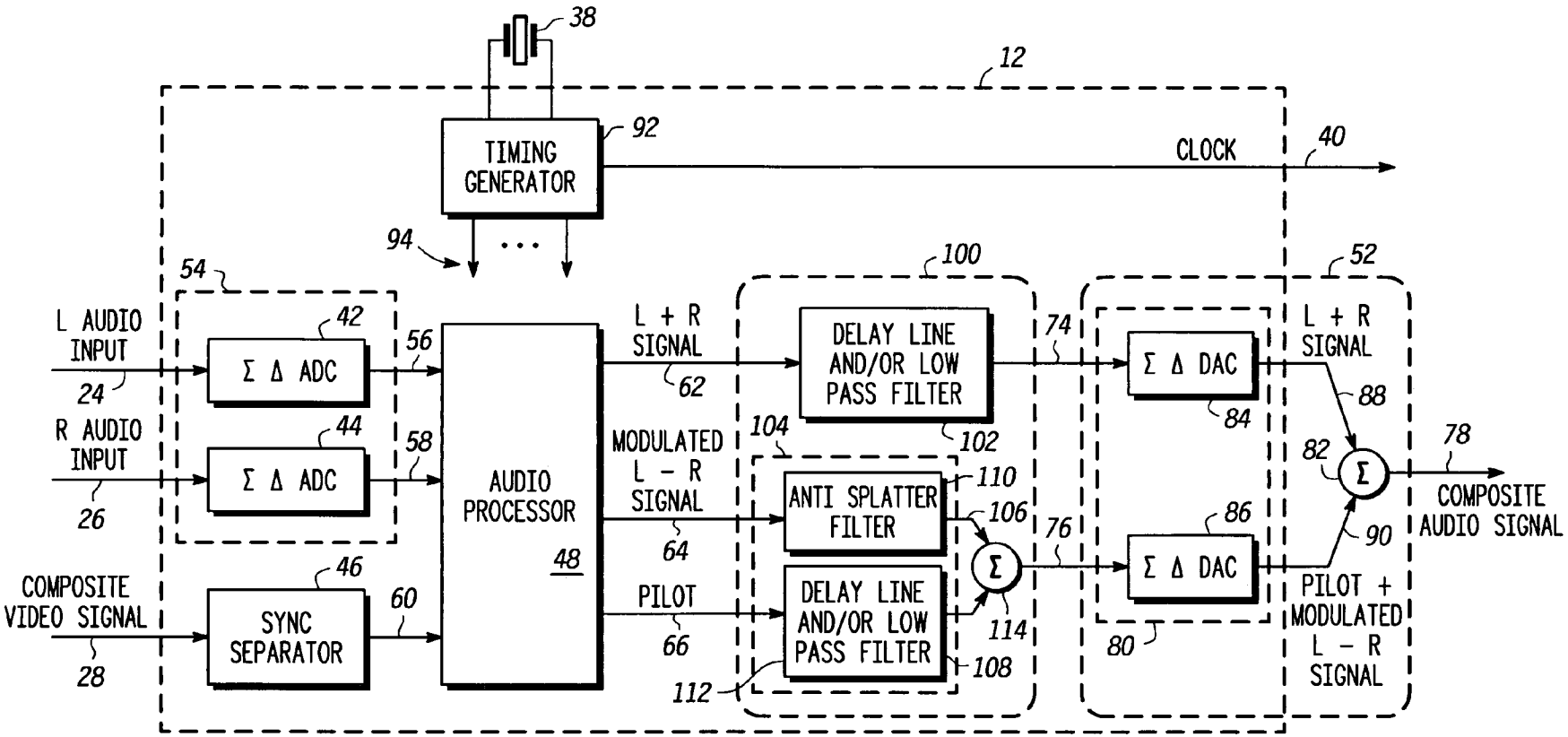
FIG. 3 is a schematic block diagram view of a BTSC encoder of FIG. 1 in further detail according to another embodiment of the present disclosure.

Referring now to FIG. 3, a schematic block diagram view of a BTSC encoder of FIG. 1 is shown in further detail according to another embodiment of the present disclosure. The BTSC encoder of FIG. 3 is similar to that of FIG. 2 with the following differences. Filtering means 100 couples to the L+R output, the modulated L−R output, and the pilot tone output of the audio processor 48. The filtering means 100 includes a first filter 102 for providing a filtered or delayed L+R signal, and a second filter 104 for providing a separately filtered modulated L−R signal and separately filtered or delayed pilot on outputs 106 and 108, respectively. A digital summing device 114 combines the outputs on 106 and 108 to provide output 76 of filtering means 100.

As mentioned, second filter 104 of filtering means 100 provides separately filtered modulated L−R and pilot signals on a second and a third output 106 and 108, respectively. The second filter 104 includes an anti-splatter filter 110 for filtering the modulated L−R signal and having an output for providing the filtered modulated L−R signal output corresponding to the first output 106 of the second filter 104. Second filter 104 further includes another filter 112 for filtering or delaying the pilot signal and having an output for providing the filtered pilot signal corresponding to the third output 108 of the second filter 104. Furthermore, the filtering means 100 outputs the filtered L+R signal on a first output 74, and outputs the combined separately filtered modulated L−R and pilot signals on output 76 via digital summing device 114.

Figure 4:
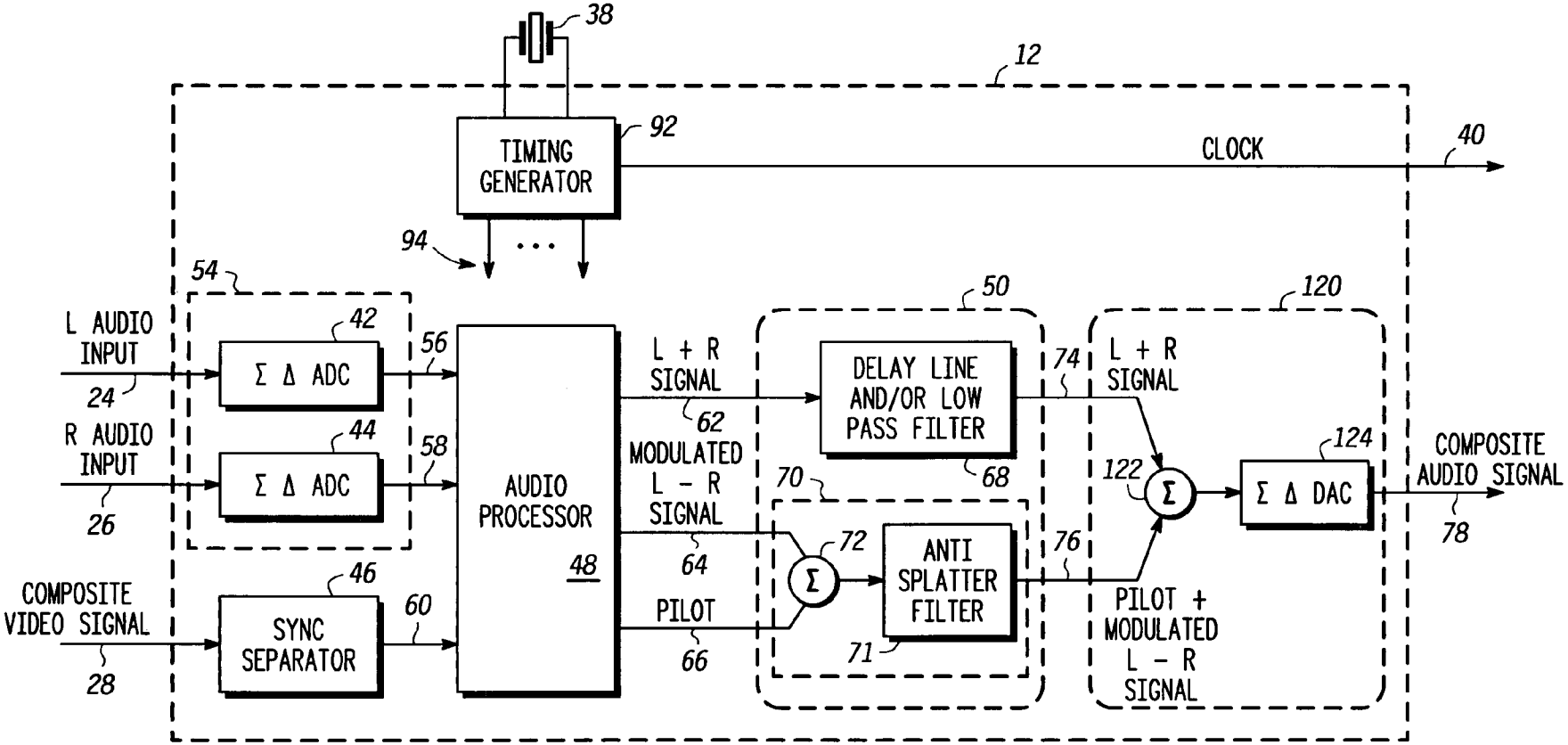
FIG. 4 is a schematic block diagram view of a BTSC encoder of FIG. 1 in further detail according to another embodiment of the present disclosure.

Referring now to FIG. 4, a schematic block diagram view of a BTSC encoder of FIG. 1 is shown in further detail according to another embodiment of the present disclosure. The BTSC encoder of FIG. 4 is similar to that of FIG. 2 with the following differences.

Composite audio signal generating means 120 couples to the first and second outputs 74 and 76, respectively, of filtering means 50. Composite audio signal generating means 120 includes a digital summing device 122 and a single channel sigma-delta digital-to-analog converter (DAC) 124. Responsive to the filtered L+R signal and the filtered and combined pilot and modulated L−R signal, the composite audio signal generating means 120 sums the input signals via summing device 122 and converts the summed signal into an analog representation via DAC 124, to generate a composite analog audio signal on composite analog audio signal output 78.

In one embodiment, BTSC encoder 12 includes a single-chip BTSC encoder, and wherein the digital summing device 122 is disposed within the single-chip BTSC encoder. Furthermore, in another embodiment, sigma-delta ADC 54 and the single channel sigma-delta DAC 124 each perform respective conversions at a substantially equal or same clock rate. The clock rate is in the range of 96 to 384 kHz. In one embodiment, the clock rate is on the order of approximately 187.5 kHz.

Figure 5:
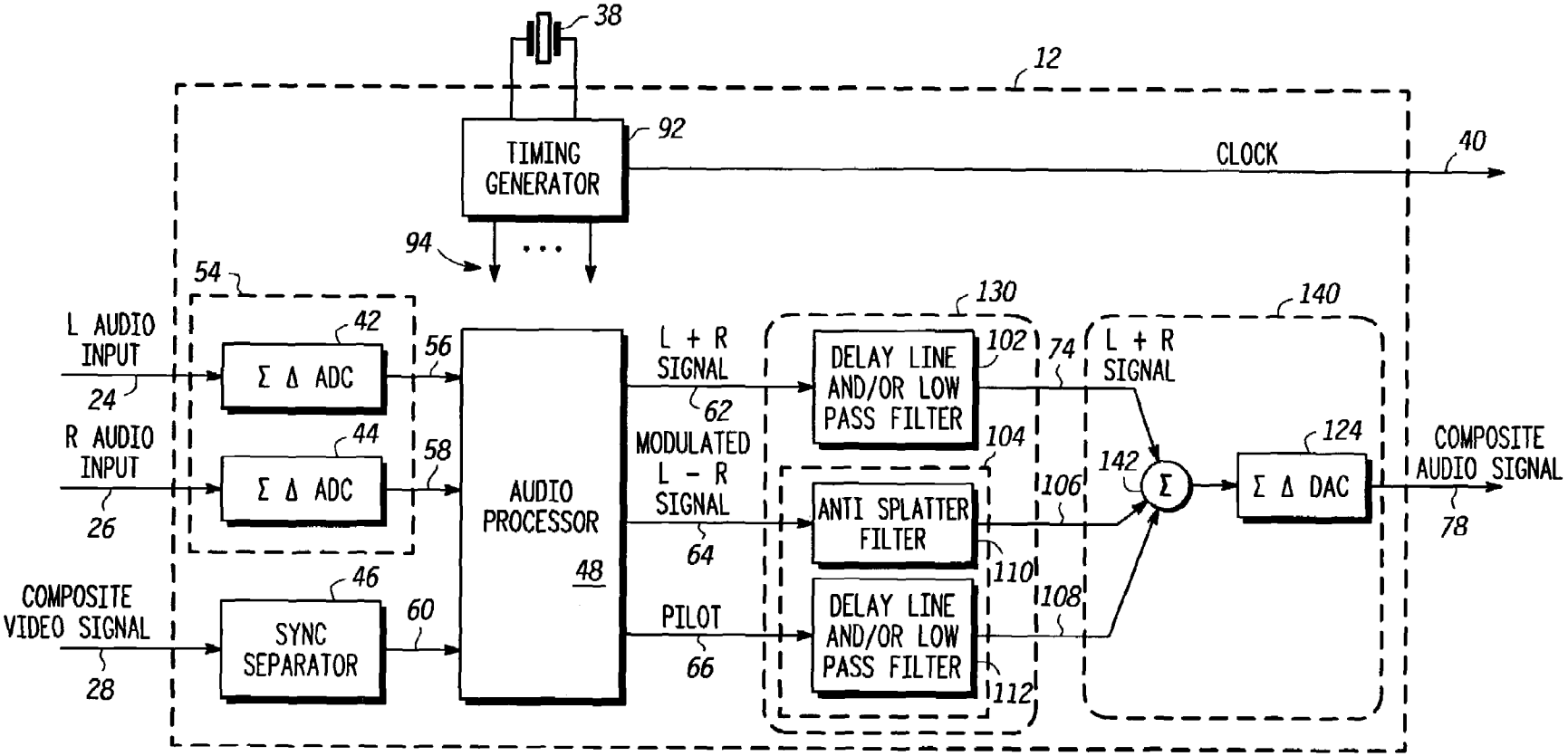
FIG. 5 is a schematic block diagram view of a BTSC encoder of FIG. 1 in further detail according to yet another embodiment of the present disclosure.

Referring now to FIG. 5, a schematic block diagram view of a BTSC encoder of FIG. 1 is shown in further detail according to another embodiment of the present disclosure. The BTSC encoder of FIG. 5 is similar to that of FIG. 4 with the following differences.

Filtering means 130 couples to the L+R output, the modulated L−R output, and the pilot tone output of the audio processor 48. The filtering means 130 includes a first filter 102 for providing a filtered L+R signal, and a second filter 104 for providing a separately filtered modulated L−R signal and separately filtered pilot on outputs 106 and 108, respectively. The second filter 104 includes an anti-splatter filter 110 for filtering the modulated L−R signal and outputting the filtered modulated L−R signal on the first output 106 of the second filter 104. Second filter 104 further includes another filter 112 for filtering the pilot signal and outputting the filtered pilot signal on the third output 108 of the second filter 104.

Composite audio signal generating means 140 couples to the outputs 74, 106 and 108 of filtering means 130. Composite audio signal generating means 140 includes a digital summing device 142 and a single channel sigma-delta digital-to-analog converter (DAC) 124. Responsive to the filtered L+R, modulated L−R signal, and pilot signals, the composite audio signal generating means 140 sums the input signals via summing device 142 and converts the resultant summed signal into an analog representation via DAC 124, to generate a composite analog audio signal on composite analog audio signal output 78.

The digital summing device 142 includes a L+R digital audio input coupled to the L+R output of the audio processor 48, a modulated L−R digital audio input coupled to the modulated L−R output of the audio processor 48, and a pilot input coupled to the pilot output of the audio processor 48, via filtering means 130. Responsive to the filtered L+R digital audio, the modulated L−R digital audio, and the pilot tone signals, the digital summing device 142 digitally sums the respective input signals into a composite L+R and combined pilot and modulated L−R digital audio signal. The digital summing device outputs the composite L+R and combined pilot and modulated L−R digital audio signal on a digital summing device output to the sigma-delta DAC 124.

Sigma-delta DAC 124 includes an input coupled to the summing device output and is adapted for receiving the composite L+R and combined pilot and modulated L−R digital audio signal. Responsive to the composite L+R and combined pilot and modulated L−R digital audio signal, the sigma-delta DAC 124 converts the input signal into a composite L+R and combined pilot and modulated L−R analog audio signal. Sigma-delta DAC 124 outputs the composite L+R and combined pilot and modulated L−R analog audio signal on a sigma-delta DAC output, corresponding to output 78 of BTSC encoder 12.

Figure 6:
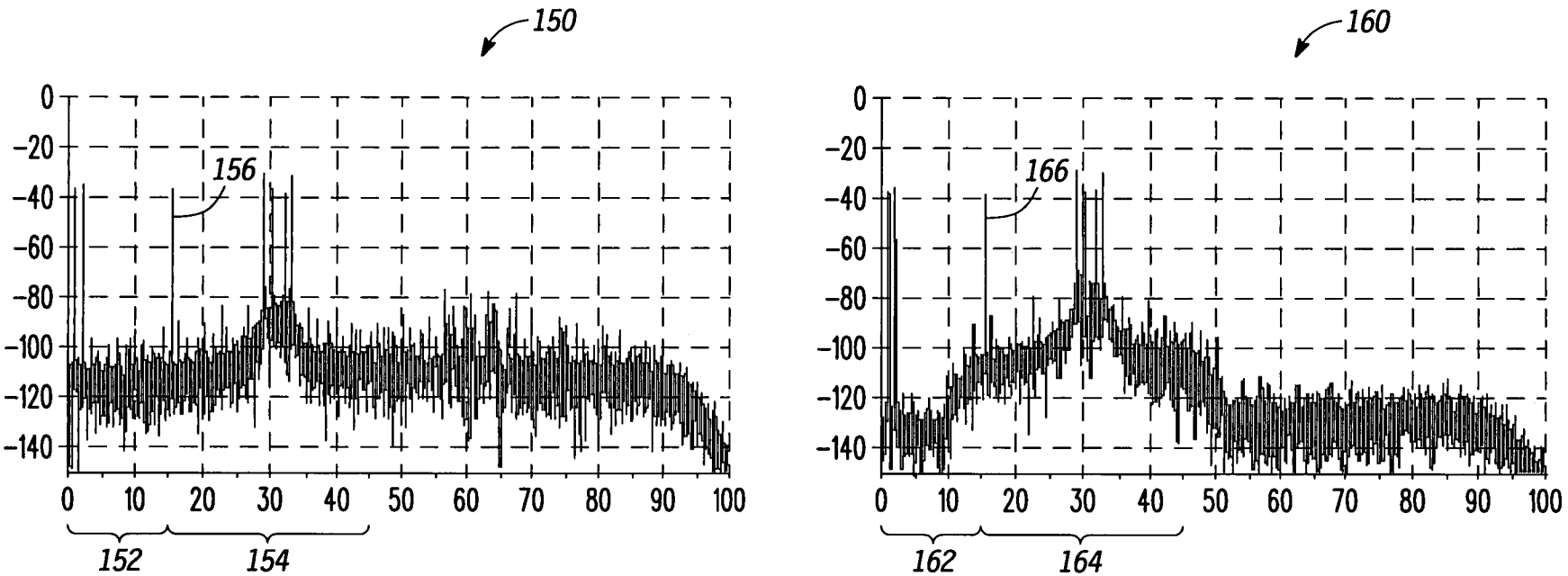
FIG. 6 is a graphical representation comparison view of spectra of composite audio from a BTSC encoder without an anti-splatter filter and the BTSC encoder including the anti-splatter filter according to the embodiments of the present disclosure.

FIG. 6 is a graphical representation comparison view of spectra of composite audio from a BTSC encoder without an anti-splatter filter and the BTSC encoder including the anti-splatter filter 71 according to the embodiments of FIGS. 2 and 4, of the present disclosure. In the spectra, the vertical axis is in units of dB and the horizontal axis is in units of kHz.

The image on the left-hand side of FIG. 6 designated by reference numeral 150 illustrates a spectrum of composite audio of a BTSC encoder without an anti-splatter filter. The modulated L−R channel (indicated by reference numeral 154) is much noisier than the other channel (i.e., the L+R channel, indicated by reference numeral 152). Due to the compression process, the noise increases as the L−R level decreases. The pilot is designated by reference numeral 156.

Referring still to FIG. 6, the image on the right-hand side designated by reference numeral 160 illustrates a spectrum of composite audio of a BTSC encoder with an anti-splatter filter according to the embodiments of the present disclosure. The image 160 on the right-hand side of FIG. 6 shows an improved noise rejection over the image 150 on the left-hand side. According to the embodiments of the present disclosure, the anti-splatter filter reduces an out-of-band noise added to the L+R channel 162, thereby improving device performance. Note that the L+R channel 162 contains less noise than the L+R channel 152. The modulated L−R channel of image 160 is indicated by reference numeral 164. The pilot is designated by reference numeral 166.

Advantages of the embodiments of the present disclosure include one or more of a cost reduction on the order of fifty percent (50%) or more (compared to solutions based on discrete parts), better performance, and a simplified system design.

According to one embodiment, an integrated circuit includes mixed-signal blocks (Sigma-Delta ADCs and DACs, Sync Separator), an audio processor for BTSC encoding, and an anti-splatter filter.

The embodiments of the present disclosure provide for a simplified decimator and for elimination of an $F_s$-to-$4F_s$ interpolator, thereby reducing an area requirement. In addition, an original frequency plan simplifies system requirements.

According to one embodiment of the present disclosure, a Multi-Channel Television Sound (MTS) stereo encoder includes a single-chip, CMOS implementation of a Broadcast Television Systems Committee (BTSC)-compatible stereo encoder. The MTS stereo encoder can be used in set-top boxes, VCRs, DVD players/recorders, game stations, and other applications that can benefit from high-quality stereo sound through a single RF coaxial cable. The digital audio processing of the single-chip MTS stereo encoder preserves the full fidelity of surround sound and other audio coding schemes. In addition, the MTS stereo encoder processes right and left analog audio signals and baseband composite video to generate a stereophonic composite signal in accordance with BTSC system standards. Moreover, in another embodiment, the MTS stereo encoder outputs the stereophonic composite signal to an RF modulator, which in turn produces a stereo encoded RF channel for use with any BTSC stereo television receiver.

Advantages of the embodiments of the present disclosure further include enabling a lower system component count, use of a smaller system board size, and significantly lower overall system cost. Furthermore, the embodiments eliminate manual alignment of filters, phase controls, and composite signal amplitude controls.

The MTS stereo encoder includes various modules. In a phased lock loop (APLL) module, the APLL module locks to a reference frequency of 12 MHz and generates a master clock. The APLL module includes an oscillator, a voltage controlled oscillator (VCO), and a clock generator. The oscillator has a crystal input and a crystal output for being coupled across a crystal oscillator, for example, a 12 MHz crystal. The oscillator provides a reference clock to an input of the VCO. Responsive to the reference clock input, the VCO outputs a phase-locked-loop output signal to an input of the clock generator. Responsive to the input signal, the clock generator, in addition to generating the clocks for all the blocks of the encoder, also generates a clock for the RF modulator, for example, 4 MHz.

In a sync separator module, the sync separator module extracts a composite sync from an incoming composite video baseband signal (CVBS). The composite sync is used by an audio processor module portion of the MTS stereo encoder to generate a 15.734 kHz pilot tone and a 31.468 kHz carrier to modulate the L−R channel. In one embodiment, the nominal output level of composite video signal sources is on the order of 1 $V_{pp}$ on 75 Ω and the sync amplitude is on the order of 0.2857 V.

According to the embodiments of the present disclosure, a fully integrated digital system provides a more cost-effective solution. In the single-chip BTSC encoder, all signal processing is digitally performed by the audio processor, while on-chip stereo Sigma-Delta ADC, stereo Sigma-Delta DAC, as well as, a sync separator interface the chip with the external analog world. Since oversampling converters are employed, anti-aliasing and smoothing filters are kept simple. In addition, external passive components are kept to a minimum.

In one embodiment, the single-chip BTSC encoder has two outputs, a L+R channel (stereophonic sum) and modulated L−R channel (stereophonic difference), which must be scaled and added together in the analog domain to generate the composite audio. BTSC encoding algorithms are implemented in the audio processor.

In another embodiment, the single-chip BTSC encoder has two outputs, a L+R channel (stereophonic sum) and modulated L−R channel (stereophonic difference), which must be scaled and added together in the digital domain to generate the composite audio. This provides at least two advantages: 1) only a single Sigma-Delta DAC is needed; 2) the amplitude ratio of the two channels is more accurately implemented as specified by the BTSC standard with digital scaling and therefore the amplitude ratio does not depend on the tolerance of analog components.

An original frequency plan based on a sampling frequency of 187.5 kHz has been devised to reduce the complexity of the clock generation. In fact, all clocks could be derived directly from the crystal oscillator, thus avoiding the use of a phase-locked-loop (PLL).

As discussed herein, with respect to traditional digital BTSC encoders, the modulated L−R channel is much noisier than the L+R channel. When combining the two channels together, the L−R channel out-of-band noise is added to the L+R channel as well, thus affecting an overall system performance. With the embodiments of the present disclosure, this problem has been solved by inserting a digital anti-splatter filter on the modulated L−R output to reduce the out-of-band noise. The filter characteristic can include a highpass filter or a bandpass filter. The filter also has very tight requirements as regards to phase distortion. In one embodiment, the anti-splatter filter is placed at the output of the audio processor of the single-chip BTSC encoder.

In existing digital BTSC encoders, the left and right input audio signals are digitized at a baseband sampling frequency. Part of the signal processing is performed at the baseband sampling frequency ($F_s$) and part at a frequency four (4) times higher (i.e., $4F_s$). As a result, interpolators are required to upsample the signals.

According to the embodiments of the present disclosure, the incoming left and right audio signals are digitized directly at a higher rate of 187.5 kHz and all BTSC signal processing is performed at this sampling frequency. This has the advantage that a simplified decimator is needed in the Sigma-Delta ADCs and no interpolator is required.

With the embodiments of the present disclosure, equipment can be constructed to include built-in BTSC encoders as disclosed herein. Accordingly, various audio/video applications with the built-in BTSC encoders can be serially connected (or daisy chained) via coaxial cables to a set-top box and all receive stereo audio. Moreover, the wiring is simplified.

In the foregoing specification, the invention has been described with reference to specific embodiments. However, one of ordinary skill in the art appreciates that various modifications and changes can be made without departing from the scope of the present invention as set forth in the claims below. For example, the sigma-delta DAC may be external to the BTSC encoder. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A BTSC (Broadcast Television Systems Committee) encoder, comprising:

a dual-channel sigma-delta analog-to-digital converter (ADC) having a left (L) audio input adapted for receiving a left (L) audio signal and a right (R) audio input adapted for receiving a right (R) audio signal, wherein responsive to L audio and R audio input signals, said dual-channel sigma-delta ADC converts the input signals into left and right digital audio output signals, respectively, and outputs the left and right digital audio output signals onto left and right digital audio outputs, respectively;

a sync separator having a composite video input adapted for receiving a composite video signal, wherein responsive to the composite video input signal, said sync separator separates a horizontal synchronization signal from the composite video input signal and outputs the synchronization signal on a synchronization output;

an audio processor having left and right digital audio inputs coupled to the left and right digital audio outputs of said dual-channel sigma-delta ADC and having a synchronization signal input coupled to the synchronization output of said sync separator, wherein responsive to left and right digital audio input signals and a synchronization signal, said audio processor processes the input and synchronization signals into a left+right (L+R) signal, a modulated left−right (L−R) signal, and a pilot tone signal, further wherein said audio processor outputs the L+R, modulated L−R, and pilot tone signals on a L+R output, a modulated L−R output, and a pilot tone output, respectively;

filtering means coupled to the L+R output, the modulated L−R output, and the pilot tone output of said audio processor, said filtering means including a first filter for providing a filtered L+R signal, and a second filter for providing at least one of: i) a filtered and combined pilot and modulated L−R signal and ii) separately filtered pilot and modulated L−R signals, further wherein said filtering means outputs the filtered L+R signal on a first output, and outputs one of i) the filtered and combined pilot and modulated L−R signal on a second output and ii) the separately filtered pilot and modulated L−R signals on a second and a third output, respectively; and composite audio signal generating means coupled to the first output and one of i) the second output and ii) the second and third outputs, wherein responsive to the filtered L+R signal, and at least one of i) the filtered and combined pilot and modulated L−R signal and ii) the separately filtered pilot and modulated L−R signals, said composite audio signal generating means generating a composite analog audio signal, further wherein said composite signal generating means outputs the composite analog audio signal on a composite analog audio signal output of said composite audio signal generating means.

2. The BTSC encoder of claim 1, wherein the second filter of said filtering means provides the filtered and combined pilot and modulated L−R signal, the second filter including a digital summer for combining the pilot and modulated L−R signals coupled to an input of an anti-splatter filter, the anti-splatter filter having an output for providing the filtered and combined pilot and modulated L−R signal output corresponding to the second output of the filter means.

3. The BTSC encoder of claim 2, wherein the anti-splatter filter reduces an amount of an out-of-band noise added to the L+R signal as a function of a combination of the pilot tone and an unfiltered modulated L−R signal.

4. The BTSC encoder of claim 2, wherein the anti-splatter filter includes one of a bandpass filter and a highpass filter.

5. The BTSC encoder of claim 2, wherein the first filter includes one of a delay line and a low pass filter.

6. The BTSC encoder of claim 1, wherein the second filter of said filtering means provides separately filtered pilot and modulated L−R signals on a second and a third output, respectively, the second filter including an anti-splatter filter for filtering the modulated L−R signal and outputting a filtered modulated L−R signal, and another filter for filtering the pilot signal and outputting a filtered pilot signal.

7. The BTSC encoder of claim 6, wherein the anti-splatter filter reduces an amount of an out-of-band noise added to the L+R signal as a function of a combination of the pilot tone and an unfiltered modulated L−R signal.

8. The BTSC encoder of claim 6, wherein the anti-splatter filter includes one of a bandpass filter and a highpass filter.

9. The BTSC encoder of claim 6, wherein the first filter and the another filter include one of a delay line and a low pass filter.

10. The BTSC encoder of claim 1, wherein said composite audio signal generating means includes a dual-channel sigma-delta digital-to-analog converter (DAC) and an analog summing device.

11. The BTSC encoder of claim 10, wherein said sigma-delta ADC and the dual-channel sigma-delta DAC each perform respective conversions at a substantially equal clock rate.

12. The BTSC encoder of claim 11, wherein the clock rate is in the range of 96 to 384 kHz.

13. The BTSC encoder of claim 11, wherein the clock rate is on the order of 187.5 kHz.

14. The BTSC encoder of claim 10, further wherein the dual-channel sigma-delta DAC includes a L+R digital audio input coupled to the L+R output of said audio processor and adapted for receiving the L+R signal, a modulated L−R digital audio and pilot tone input coupled to the modulated L−R and pilot tone outputs of said audio processor and adapted for receiving a combined modulated L−R digital audio and pilot tone signal, wherein responsive to the L+R digital audio signal and the combined modulated L−R digital audio and pilot tone signal, the dual-channel sigma-delta DAC converts the input signals into L+R and combined modulated L−R analog audio output signals, respectively, and further wherein the dual-channel sigma-delta DAC outputs the L+R and combined pilot and modulated L−R analog audio output signals on L+R and combined pilot and modulated L−R analog audio outputs, respectively, and wherein the analog summing device includes a L+R analog audio input and a combined pilot and modulated L−R analog audio input coupled to the L+R and combined pilot and modulated L−R analog audio outputs, respectively, of the dual-channel sigma-delta DAC, for summing the L+R and combined modulated L−R analog audio output signals into a composite analog audio signal, further wherein said analog summing device outputs the composite analog audio signal on an analog summing device output.

15. The BTSC encoder of claim 10, wherein said BTSC encoder includes a single-chip BTSC encoder and wherein said analog summing device is disposed within the single-chip BTSC encoder.

16. The BTSC encoder of claim 10, wherein said BTSC encoder includes a single-chip BTSC encoder and wherein said analog summing device is disposed external to the single-chip BTSC encoder.

17. The BTSC encoder of claim 1, wherein said composite audio signal generating means includes a digital summing device and a single channel sigma-delta digital-to-analog converter (DAC).

18. The BTSC encoder of claim 17, wherein said sigma-delta ADC and the single channel sigma-delta DAC each perform respective conversions at a substantially equal clock rate.

19. The BTSC encoder of claim 18, wherein the clock rate is in the range of 96 to 384 kHz.

20. The BTSC encoder of claim 18, wherein the clock rate is on the order of 187.5 kHz.

21. The BTSC encoder of claim 17, further wherein the digital summing device includes a L+R digital audio input coupled to the L+R output of said audio processor and adapted for receiving the L+R signal, said digital summing device further having a modulated L−R digital audio and pilot tone input coupled to the modulated L−R and pilot tone outputs of said audio processor and adapted for receiving a combined modulated L−R digital audio and pilot tone signal, wherein responsive to the L+R digital audio signal and combined modulated L−R digital audio and pilot tone signal, said digital summing device digitally sums the respective input signals into a composite L+R and combined pilot and modulated L−R digital audio signal, wherein further said digital summing device outputs the composite L+R and combined pilot and modulated L−R digital audio signal on a digital summing device output; and wherein the sigma-delta DAC includes an input coupled to the summing device output and adapted for receiving the composite L+R and combined pilot and modulated L−R digital audio signal, wherein responsive to the composite L+R and combined pilot and modulated L−R digital audio signal, the sigma-delta DAC converts the input signal into a composite L+R and combined pilot and modulated L−R analog audio signal, and further wherein the sigma-delta DAC outputs the composite L+R and combined pilot and modulated L−R analog audio signal on a sigma-delta DAC output.

22. An integrated circuit comprising:

a BTSC encoder according to claim 1, including a left audio input for receiving a left audio input signal, a right audio input for receiving a right audio signal, and a composite video input for receiving a composite video signal, wherein responsive to the left audio, right audio, and composite input signals, wherein said BTSC encoder digitally encodes the left and right audio input signals into a composite analog audio signal and outputs the composite analog audio signal on a composite analog audio output of said BTSC encoder; and an RF modulator having a composite audio input coupled to the composite analog audio output of said BTSC encoder for receiving the composite analog audio output signal, said RF modulator further having a composite video input for receiving the composite video signal, wherein responsive to the input signals, said RF modulator for modulating the composite audio and video input signals into an RF modulated output signal and outputting the RF modulated output signal on an RF modulated output of said RF modulator.

23. The integrated circuit of claim 22, wherein said BTSC encoder includes a single-chip BTSC encoder.

24. The integrated circuit of claim 22, wherein said BTSC encoder generates and provides a clock signal to said RF modulator.

* * * * *